US006863376B2

(12) United States Patent
Seino et al.

(10) Patent No.: US 6,863,376 B2
(45) Date of Patent: Mar. 8, 2005

(54) INK CARTRIDGE AND INK-JET RECORDING APPARATUS

(75) Inventors: Takeo Seino, Nagano (JP); Satoshi Shinada, Nagano (JP); Hisashi Miyazawa, Nagano (JP); Yasuto Sakai, Nagano (JP); Masaki Shimomura, Nagano (JP); Satoshi Nakata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/116,279

(22) Filed: Apr. 3, 2002

(65) Prior Publication Data

US 2003/0107627 A1 Jun. 12, 2003

(30) Foreign Application Priority Data

Apr. 3, 2001 (JP) ..... P2001-104526
Jul. 6, 2001 (JP) ..... P2001-206342
Aug. 31, 2001 (JP) ..... P2001-263779

(51) Int. Cl.[7] ..... B41J 2/14
(52) U.S. Cl. ..... 347/49
(58) Field of Search ..... 347/37, 49, 85, 347/86, 87

(56) References Cited

U.S. PATENT DOCUMENTS 5,138,344 A 8/1992 Ujita
5,619,237 A * 4/1997 Inoue et al. ..... 347/86
5,815,183 A * 9/1998 Sasaki ..... 347/86

(List continued on next page.)

FOREIGN PATENT DOCUMENTS

EP 0 622 208 A2 11/1994
EP 0 623 471 A2 11/1994
EP 0 822 084 A2 2/1998
EP 822 084 A2 2/1998
EP 0 860 284 A2 8/1998
EP 0 956 958 A2 11/1999
EP 0 997 297 A1 5/2000
EP 1 000 749 A2 5/2000
EP 1 004 449 A2 5/2000
EP 1 114 726 A1 7/2001
EP 1 12 076 A1 8/2001
EP 1 219 438 A2 7/2002
EP 1 247 651 A2 10/2002
EP 1 297 962 A1 4/2003
JP 9-11500 A 1/1997
JP 9-11500 A 1/1997
JP 10-44451 A 2/1998
JP 10-44451 A 2/1998
JP 11-309869 A 11/1999
JP 11-309870 A 11/1999
JP 11-309875 A 11/1999
JP 11-309876 A 11/1999
JP 2000-15831 A 1/2000
JP 2001-105587 A 4/2001
WO WO-01/54910 A2 8/2001

OTHER PUBLICATIONS

U.S. Appl. No. 09/525,477, filed Mar. 15, 2000, Miyazawa.
U.S. Appl. No. 10/778,766, filed Feb. 13, 2004, Miyazawa et al.
U.S. Appl. No. 10/819,759, filed Apr. 6, 2004, Miyazawa.
U.S. Appl. No. 10/826,918, filed Apr. 16, 2004, Miyazawa et al.
U.S. Appl. No. 10/649,806, filed Aug. 26, 2003, Hashii et al.
Search Report from EP 02007299.7 (Jun. 27, 2003).

*Primary Examiner*—Anh T. N. Vo
(74) *Attorney, Agent, or Firm*—Stroock & Stroock & Lavan LLP

(57) ABSTRACT

An ink cartridge has pivotable levers connected to walls of a container, and both pawls and protruded guide portions formed on the levers. The pawls are engageable with an ink cartridge holder. The protruded guide portions contact the ink cartridge holder to move the levers in the opening direction. Further, protruded stopper portions are formed to permit pivoting movement of the levers to such a degree as to disengage the pawls from the ink cartridge holder.

27 Claims, 10 Drawing Sheets

U.S. PATENT DOCUMENTS 5,835,817 A 11/1998 Bullock et al.
6,000,788 A 12/1999 Iida
6,042,211 A 3/2000 Hudson et al.
6,050,669 A 4/2000 Yano et al.
6,155,678 A * 12/2000 Komplin et al. ..... 347/86
6,193,364 B1 2/2001 Iida
6,276,780 B1 8/2001 Carrese et al.
6,302,531 B1 10/2001 Usui et al.
6,302,535 B1 * 10/2001 Sturgeon et al. ..... 347/86
6,390,611 B1 5/2002 Kobayashi et al.
6,422,691 B2 7/2002 Kobayashi et al.
6,460,984 B1 10/2002 Matsumoto et al.
6,488,369 B1 12/2002 Steinmetz et al.
6,550,901 B2 4/2003 Iida
6,585,358 B2 7/2003 Usui et al.
6,648,459 B2 11/2003 Usui et al.
6,666,551 B2 12/2003 Kobayashi et al.
2002/0085075 A1 7/2002 Shinada et al.
2002/0089083 A1 7/2002 Nishimuro et al.
2002/0109760 A1 8/2002 Miyazawa et al.
2002/0135646 A1 9/2002 Usui
2002/0154200 A1 10/2002 Miyazawa et al.
2002/0158948 A1 10/2002 Miyazawa et al.
2002/0171721 A1 11/2002 Ota et al.
2002/0171722 A1 11/2002 Hara et al.
2002/0171723 A1 11/2002 Ota et al.
2002/0180849 A1 12/2002 Sakai et al.
2003/0007043 A1 1/2003 Ota et al.
2003/0058312 A1 3/2003 Iida
2003/0058313 A1 3/2003 Iida
2003/0085970 A1 5/2003 Sakai et al.
2003/0103119 A1 6/2003 Sakai et al.
2003/0107629 A1 6/2003 Kobayashi et al.
2003/0128261 A1 7/2003 Usui et al.
2003/0146959 A1 8/2003 Iida
2004/0051766 A1 3/2004 Miyazawa et al.
2004/0056936 A1 3/2004 Usui et al.
2004/0085415 A1 5/2004 Kobayashi et al.

* cited by examiner

INK CARTRIDGE AND INK-JET RECORDING APPARATUS

BACKGROUND OF THE INVENTION

The present invention relates to a recording apparatus in which an ink cartridge is loaded into a carriage to supply ink to an ink-jet recording head mounted in the carriage. The present invention also relates to an ink cartridge appropriate for such a recording apparatus.

A recording apparatus, in which an ink container is detachably mounted on a carriage carrying an ink-jet recording head, includes a retaining mechanism for preventing the removal or shifting of the ink container due to the motion of the carriage during printing, and for permitting the easy removal of the ink container by an external operation.

As disclosed, for example, in JP-A-10-44451, such a retaining mechanism is arranged so that a protruded portion for engagement with an ink cartridge holder on a first side face of an ink tank, and a pawl is formed on a pivotable lever on the second and opposite side face thereof. When the protruded portion engages the ink cartridge holder, the opposite face rotates about the protruded portion until the pawl is engaged with the ink cartridge holder.

However, such a retaining mechanism, which mounts the ink cartridge using the rotation of the ink cartridge is not suitable for an ink container forming an ink flow path via an ink supply needle communicating with a recording head.

That is, since the ink supply needle has a predetermined length enabling it to surely communicate with an ink container, the ink supply needle may be broken upon the application of an external force in a direction other than the axial direction, such as rotation in the manner just described. Thus, the ink container must be moved parallel to the longitudinal (axial) direction of the ink supply needle.

Further, as disclosed in JP-A-9-11500, an ink cartridge is proposed which has two elastically deformable levers respectively formed on two opposite faces of an ink container. Each lever has a pawl for engagement with an ink cartridge holder so that the ink cartridge can be inserted into and connected to an ink supply needle.

In addition, especially for a recording apparatus that requires ink not having air dissolved therein, i.e., for a recording apparatus that includes a recording head employing a piezoelectric device for pressurizing ink, prior to mounting on the recording apparatus, an ink cartridge is held, under a pressure reduced state, by being stored in an air-impermeable film bag.

In this case, atmospheric pressure can apply great force to a lever through the bag, and the lever can be pressed against a container. If this force continues to be applied for a long period of time, creepage of the lever, which is typically made of polymeric material, can occur, and the function of the lever as a fixing unit can be lost.

SUMMARY OF THE INVENTION

To resolve these shortcomings, it is one objective of the invention to provide an ink cartridge that can be inserted onto or removed from an ink supply needle along the needle's axis, and that can securely engage a pawl of a lever with an ink cartridge holder regardless of whether an external force is applied for a long period of time.

It is another objective of the invention to provide a recording apparatus appropriate for this ink cartridge.

An ink cartridge according to a preferred embodiment of the present invention has a container for containing ink therein, and an ink supply port that communicates with the interior of the container and through which ink can be supplied to a recording head when the ink cartridge is mounted onto an ink cartridge holder of a recording apparatus. A lever formed on a wall of the container is pivotable about an ink supply port side thereof. The lever has a pawl engageable with the ink cartridge holder, and a guide protruded portion that contacts the ink cartridge holder to pivot the lever in an opening direction.

When the ink cartridge is mounted to the ink cartridge holder, the lever on the ink cartridge is forcibly urged outward, and the user is notified of a state that the pawl is surely engaged with the ink cartridge holder. Further, regardless of the elasticity of the lever, the pawl on the lever is kept in engagement with the ink cartridge holder with a predetermined strength.

The present disclosure relates to the subject matter contained in Japanese patent application Nos. 2001-104526 (filed on Apr. 3, 2001), 2001-206342 (filed on Jul. 6, 2001) and 2001-263779 (filed on Aug. 31, 2001), which are expressly incorporated herein by reference in their entireties.

DESCRIPTION OF THE PREFERRED EMBODIMENT

Embodiments of the invention will now be described in detail while referring to the accompanying drawings.

Figure 1A:
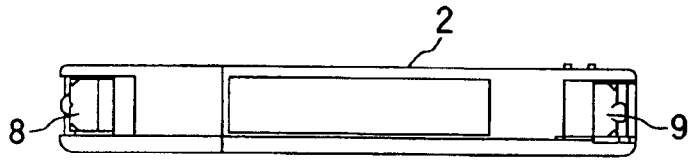
FIGS. 1A to 1C are, respectively, top, front and side views of an ink cartridge according to one embodiment of the invention.
Figure 1C:
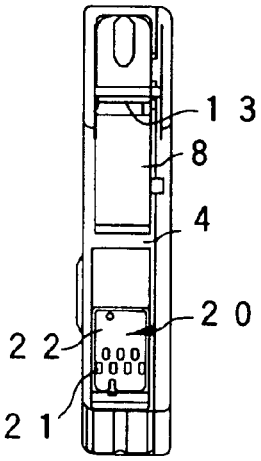
Figure 1B:
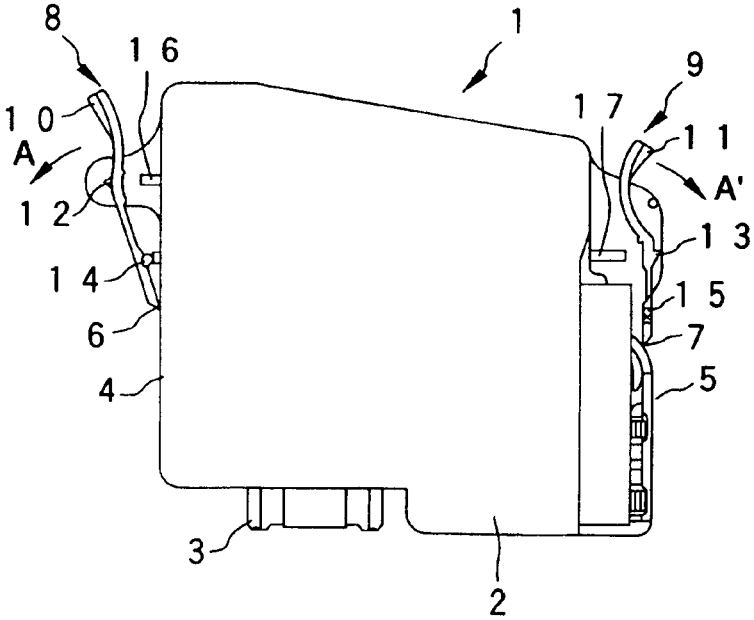

FIGS. 1A to 1C are diagrams showing an ink cartridge according to one embodiment of the invention. An ink cartridge 1 has an ink supply port 3 that is formed in the lower face of a generally flat, rectangular container 2, that communicates with an interior of the container 2, and that can receive an ink supply needle therein. Further, levers 8 and 9 are formed on side faces 4 and 5, and employ the ink supply port sides, i.e., the lower ends thereof, as pivot portions 6 and 7. That is, in this embodiment, the levers 8 and 9 are pivotable about the portions 6 and 7, respectively. It is presently thought to be preferable to form pivot portions 6 and 7 as "living hinges", which can be formed as thinned-down portions of the lever material.

Grips 10 and 11, which can be contoured, are formed on the upper ends of the levers 8 and 9, in the middle portions of which pawls 12 and 13 are formed for engagement with an ink cartridge holder 30 of a recording apparatus, which will be described later. Further, protruded guide portions 14 and 15 are formed on levers 8 and 9 between the pivot portions 6 and 7 and the pawls 12 and 13. When engaged with guide portion 35, 36 of the ink cartridge holder 30, the protruded guide portion 14, 15 is urged in an opening direction A, A'. The protruded guide portion 14 is preferably shaped like a droplet in cross section so that the lower end is slightly tapered, and the other protruded guide portion 15 is circularly shaped in cross section, although other shapes also could be used.

Protruded stopper portions 16 and 17 are formed on the side faces 4 and 5 of the container 2 at locations opposed t the pawls 12 and 13. The length of the stopper portions 16, 17 is chosen so that the lever 8, 9 can move toward the container 2 to disengage the pawl 12, 13 from the ink cartridge holder 30, and are then stopped from further motion toward the ink container 2.

In this embodiment, a storage device 20, in which data, such as the type of ink cartridge 1 and the volume of ink, are stored is mounted on the side face. This storage device 20 can be made from a circuit board 22 having an exposed, obverse face with electrodes 21 formed there on and which electrodes contact the contact points of the ink cartridge holder 30 when the ink cartridge 1 is installed in ink cartridge holder 30. A storage device (not shown) is mounted on the hidden, reverse face of the circuit board 22. Other mounting locations also could be employed.

Figure 2A:
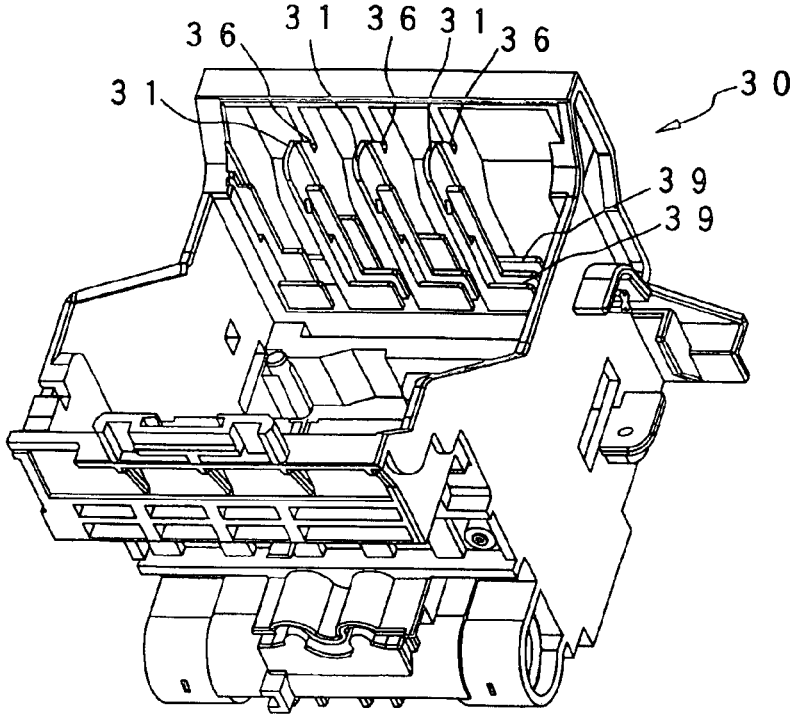
FIGS. 2A and 2B are perspective views of an example of an ink cartridge holder of a recording apparatus appropriate for an ink cartridge using the present invention.
Figure 2B:
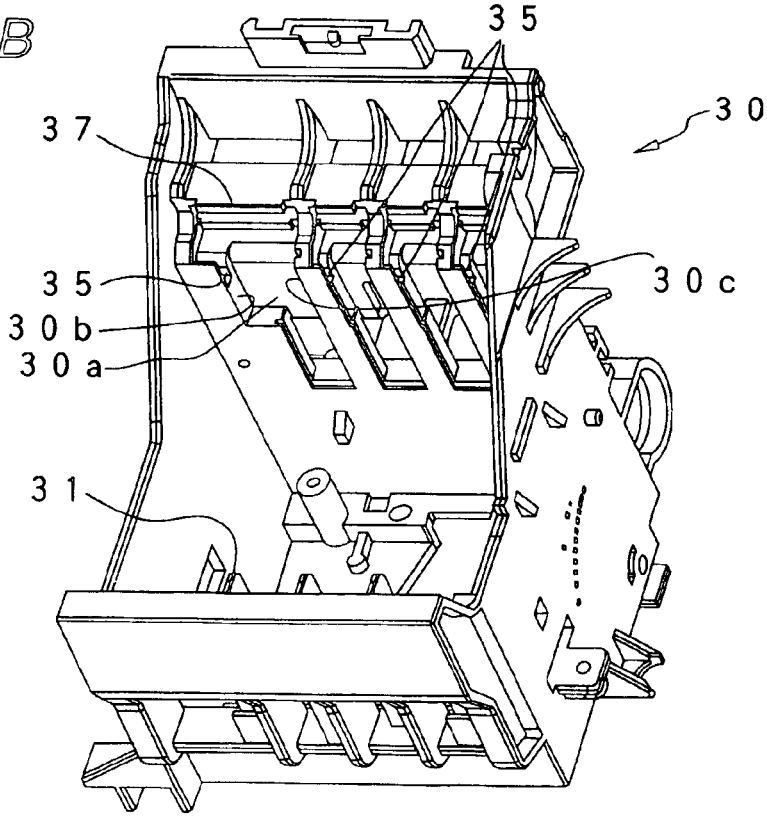
Figure 3:
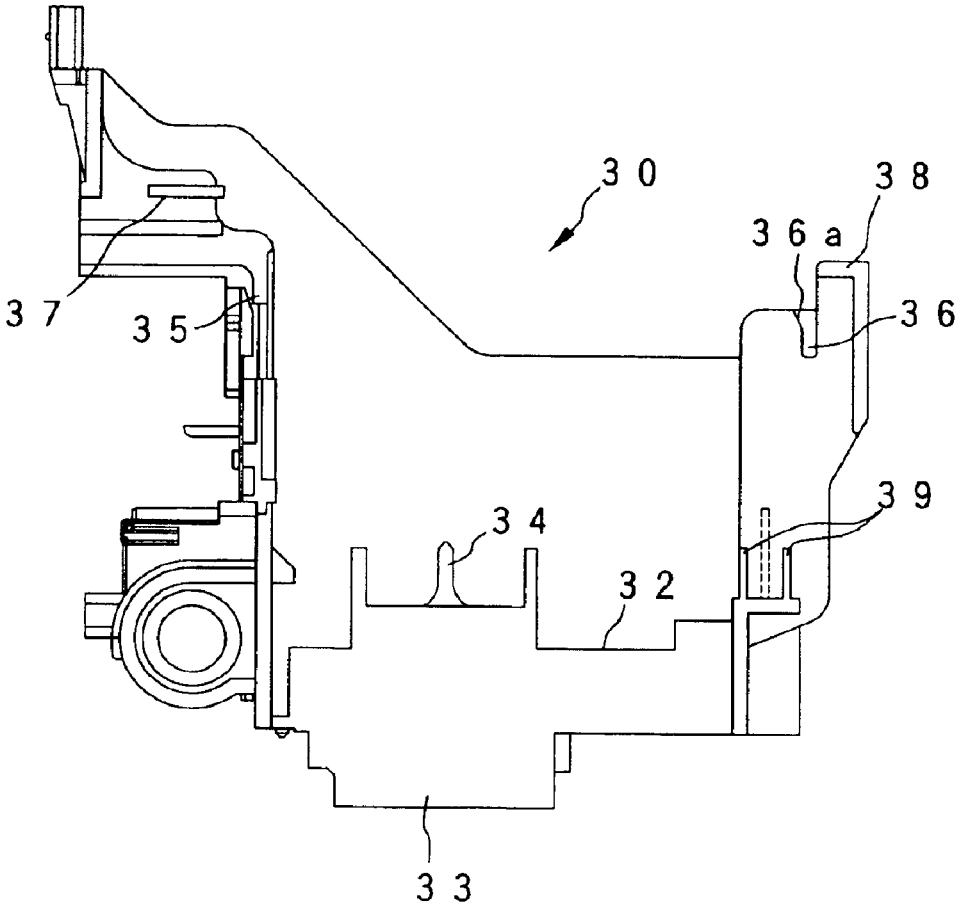
FIG. 3 is a cross-sectional view of the ink cartridge holder shown in FIGS. 2A and 2B.

FIGS. 2A and 2B are diagrams showing an example of the ink cartridge holder 30 on which the ink cartridge 1 is mounted, in which the head unit, including a recording head 33 and an ink supply needle 34, is removed. The interior of the ink cartridge holder 30 is divided into a plurality of areas by plural ribs (three ribs 31 are shown in this embodiment). The head unit 100, shown in FIG. 3 and which includes the recording head 33 and the ink supply needle 34 (four ink supply needles 34 are provided in this embodiment) that communicates with the recording head 33, is provided on the bottom face 32 of ink cartridge holder 30. The ink supply needles 34 are located in respective areas defined by the ribs 31.

Guide portions 35 and 36, each in the form of a groove or a window, are formed in the upper portion of each of the areas for engagement with the protruded guide portions 14 and 15 of ink cartridge 1. Each guide portion 35, 36 is elongated vertically to guide the protruded portion 14, 15 as it moves downward from the position of first contact with the protruded guide portion 14, 15 of the ink cartridge 1 to the position where the ink supply port 3 is securely mounted on the ink supply needle 34. The guide portion 36, which is to be engaged with the protruded guide portion 15 preferably having a circular shape in cross section, has at its upper end a slope 36*a* which is inclined toward the center of ink cartridge 1 so as to define a narrowing throat to receive the protruded guide portion 15 as it moves downward regardless of the opening degree of the lever 9.

Figure 4:
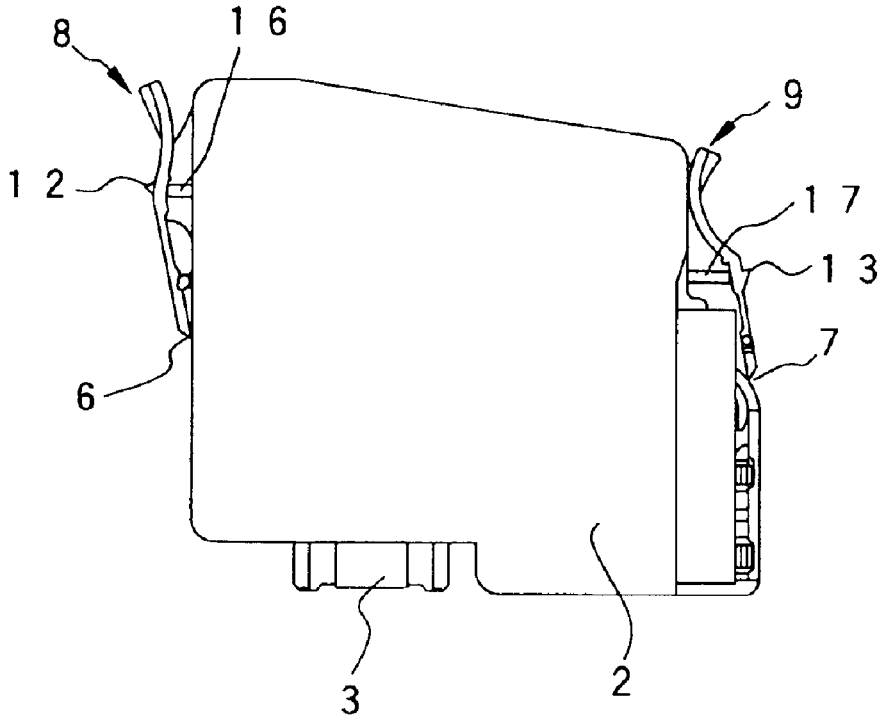
FIG. 4 is a diagram showing the ink cartridge in a state which can be accommodated in an air-impermeable bag.

In this embodiment, in the situation where the ink cartridge 1 is stored in an air-impermeable film bag under reduced pressure (less than the ambient pressure) in order to maintain the degassed state of the ink contained in the ink cartridge 1, as shown in FIG. 4, the levers 8 and 9 are pressed inward toward the container 2, through the air-impermeable bag, by the greater atmospheric pressure, but are supported and kept from moving inward by the protruded stopper portions 16 and 17 of the container 2. With this arrangement, the levers 8 and 9 are prevented from being excessively bent toward the container 2 which would, over time, result in undesirable creep of the levers 8 and 9.

Accordingly, when the ink cartridge 1 removed from the bag, the levers 8 and 9 are biased outward from the ink cartridge 1 through their own elasticity. However, there is a possibility that if the ink cartridge 1 has been stored in the bag for an extended period of time, the elasticity of the levers 8 and 9 may be reduced, or even lost entirely owing to the phenomenon of creep, in which plastic deformation of the levers 8 and 9 causes levers 8 and 9 to closely contact or be bent near the protruded stopper portions 16 and 17.

To mount the ink cartridge 1 on the ink cartridge holder 30, the levers 8 and 9 are held by thumb and index finger, and the ink cartridge 1 is inserted into the ink cartridge holder 30 with one side face located at the rear of the holder 30, i.e. the side face 4 in this embodiment, aligned parallel to the wall 30*a* of the ink cartridge holder 30. The position of the grasped lever 8, formed on the side face 4, is determined by the wall 30*a* of the ink cartridge holder 30 and the protruded stopper portion 16 so that the protruded guide portion 14 is located closely adjacent to the guide portion 35. Further, the tapered shape of the protruded guide portion 14 aids in the smooth insertion of the protruded guide portion 14 into the guide portion 35. On the other hand, the protruded guide portion 15, formed on the lever 9, is guided along the slope 36*a* of the guide portion 36, to enter the guide portion 36. Therefore, with the pivot portions 6 and 7 acting as fulcrums, the levers 8 and 9 are moved outward as the guide portions 14 and 15 move along the guide portions 35 and 36 and levers 8 and 9 become separated from the protruded stopper portions 16 and 17.

Further, as shown in FIG. 2B, in the ink cartridge holder 30, second walls 30*b* and 30*c* are formed perpendicular to the wall 30*a* to define a gap having a width that substantially corresponds to the width of the lever 8. This way, during the insertion of the ink cartridge 1, the lever 8 is moved along a predetermined path, while being restricted by the walls 30*b* and 30*c* in the widthwise direction.

The ink cartridge holder 30 is preferably provided with projecting identification pieces 39 that permit the insertion of only ink cartridges 1 appropriate to the respective areas of the ink cartridge holder 30. In that case, each of the ink cartridges 1 has corresponding recessed portions (not shown) that accommodate the projecting identification pieces 39 to permit the further insertion of the ink cartridge 1 only when the ink cartridge 1 is appropriate to the area.

By way of non-limiting example, an "appropriate" ink cartridge could be a cartridge of a particular color, type of ink, capacity or model. This system can be used to avoid attaching an ink cartridge of the wrong color or type of ink.

Figure 5A:
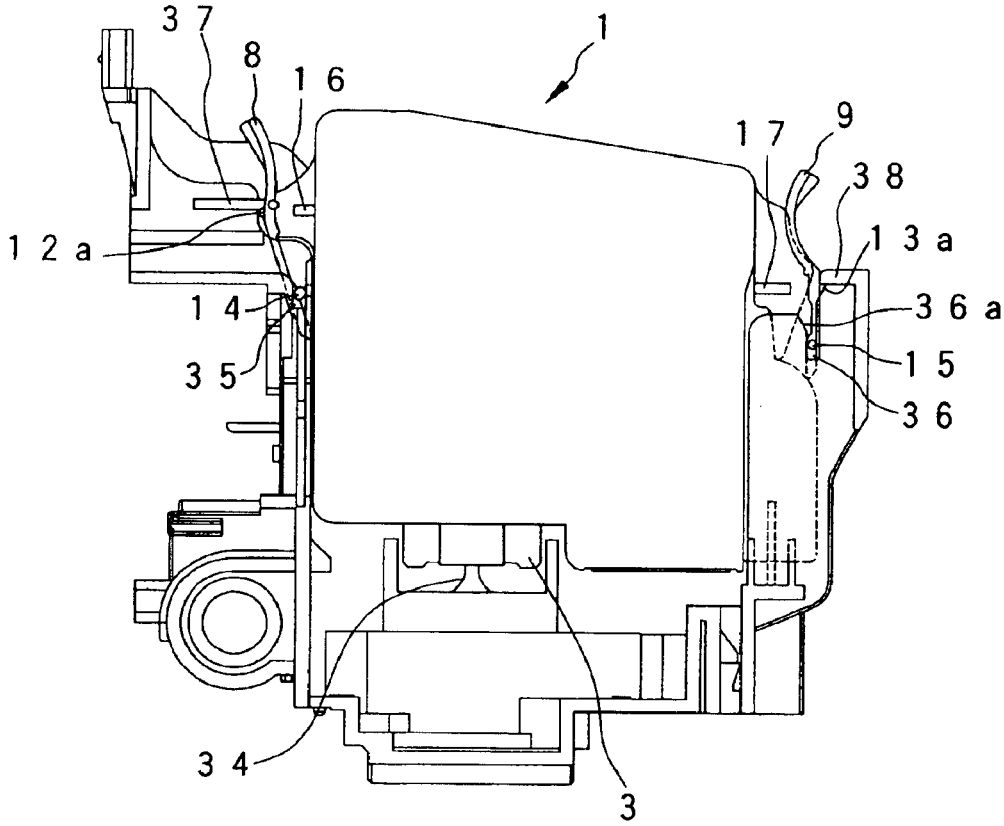
FIG. 5A is a diagram showing the ink cartridge mounted onto the ink cartridge holder.
Figure 5B:
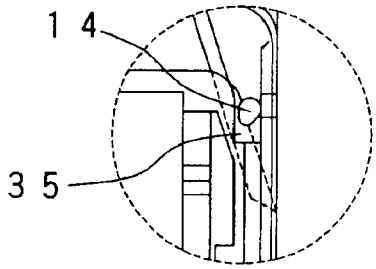
FIGS. 5B and 5C are enlarged diagrams of the areas in the vicinity of the guide portions.
Figure 5C:
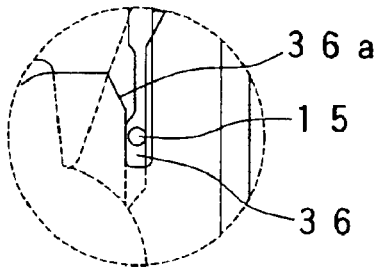

With reference now to FIGS. 5A–C, when the ink cartridge 1 is further inserted onto ink cartridge holder 30, the protruded guide portions 14 and 15 on the ink cartridge 1 are guided by the guide portions 35 and 36 of the ink cartridge holder 30 to be moved to predetermined locations, at which point sloped surfaces 12*a* and 13*a*, formed on the pawls 12 and 13 of the levers 8 and 9, contact the upper faces of engagement portions 37 and 38 of the ink cartridge holder 30 and resist further insertion of the ink cartridge 1.

When the ink cartridge 1 is further depressed in this state, as shown in FIG. 5A, the pawls 12 and 13 of the levers 8 and 9 move inward and so pass beyond the engagement portions 37 and 38 through contact by the slopes 12*a* and 13*a*. Pawls 12 and 13 then snap into positions under the lower faces of the engagement portions 37 and 38. At this time, a perceptible click, resulting from the elastic energy of the released levers 8 and 9 as they spring into position, is provided to a user, who can sense when the ink cartridge 1 has moved to its intended position, and in response, the user can avoid unnecessarily depressing the ink cartridge 1.

After the ink cartridge 1 has been mounted onto the ink cartridge holder 30, the levers 8 and 9 are constantly urged outward by the guide portions 35 and 36, so that engagement with the ink cartridge holder 30 is maintained even if a small external force is applied to the levers 8 and 9.

Once the ink in the ink cartridge 1 has been completely consumed, the ink cartridge 1 can be replaced. To do this, the user grips the levers 8 and 9 with thumb and index finger and squeezes together to elastically deform the levers 8 and 9 about the protruded guide portions 14 and 15 supported by the guide portions 35 and 36, thereby moving the pawls 12 and 13 inward and away from the engagement portions 37 and 38 of the ink cartridge holder 30. Now, when the user pulls upward on the levers 8 and 9, the ink supply port 3 is detached from the ink supply needle 34, and the ink cartridge 1 can be removed from the ink cartridge holder 30.

In this embodiment, the ink cartridge 1 has two levers 8 and 9, both of which engaged with the ink cartridge holder 3. However, so long as at least the lever 8, located on the side of the ink cartridge 1 where the storage device 20 is located is provided for engagement with the ink cartridge holder 30, it is possible to maintain both connection between the ink cartridge 1 and the ink supply needle 34, and reliable contact between the electrodes 21 of the storage device 20 and the contact points (not shown) of the ink cartridge holder 30.

Figure 6A:
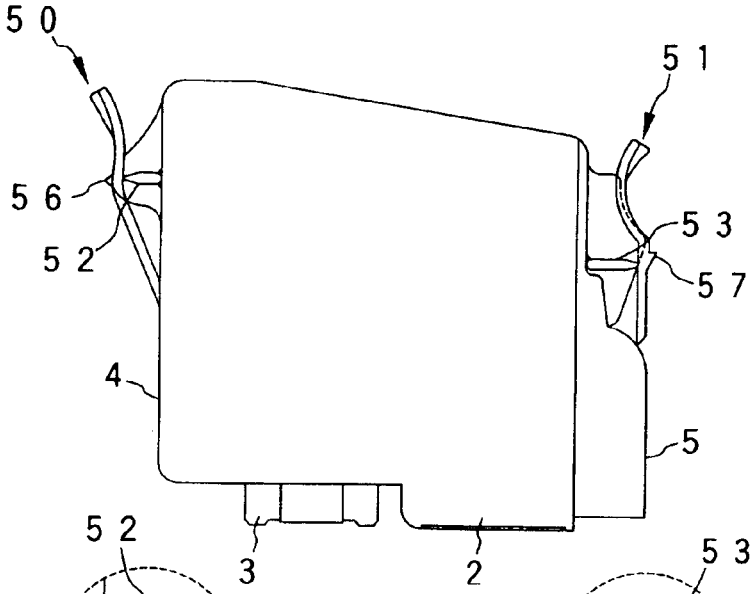
FIG. 6A is a diagram showing an ink cartridge according to another embodiment which has been removed from an air-impermeable bag.
Figure 6B:
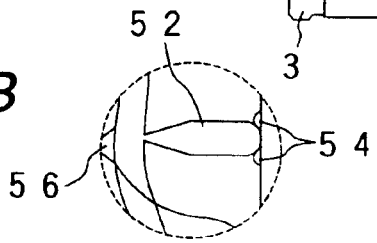
FIGS. 6B and 6C are enlarged diagrams showing the area in the vicinity of struts of the ink cartridge.
Figure 6C:
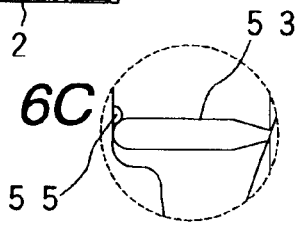

FIGS. 6A to 6C are diagrams showing an ink cartridge according to another embodiment of the invention. Pawls 56 and 57 of levers 50 and 51, which are formed on side faces 4 and 5 of a container 2 in the same manner as the previous embodiment, are supported by movable struts 52 and 53, which respectively extend from the rear (inner) faces of the levers 50 and 51, to maintain the appropriate separation between the pawls 56 and 57 and the side faces 4 and 5 of the container 2.

Movable struts 52 and 53 are constructed so that they can be deflected upward in order to allow the levers 50 and 51 to move. In this regard, it may be preferable to provide each strut 52 and 53 with a "living hinge" (not shown) so that the struts 52 and 53 bend about the living hinge. Even more preferably, the living hinges are provided at the point where the strut meets the wall of the ink cartridge 1.

Semi-circular projections or "dimples" 54 and 55 are formed on the side faces 4 and 5 of the container 2 at locations to contact the distal ends of the struts 52 and 53. One or more raised rings also could be provided. Alternatively, the tips of the struts 52 and 53 could be rounded and fit into small matching depressions in the wall of the container 2.

According to this embodiment, when the ink cartridge 1 is shipped from a factory, the ink cartridge 1 is stored in an air-impermeable film bag under reduced pressure (pressure less than ambient) so that the struts 52 and 53 are pressed against and engage with the semi-circular projections 54 and 55. Owing to their placement, projections 54 and 55 hold the struts 52 and 53 substantially perpendicular to the side faces 4 and 5. The struts thereby limit upward movement of the pawls 56 and 57 on the levers 50 and 51 toward the container 2.

Figure 6D:
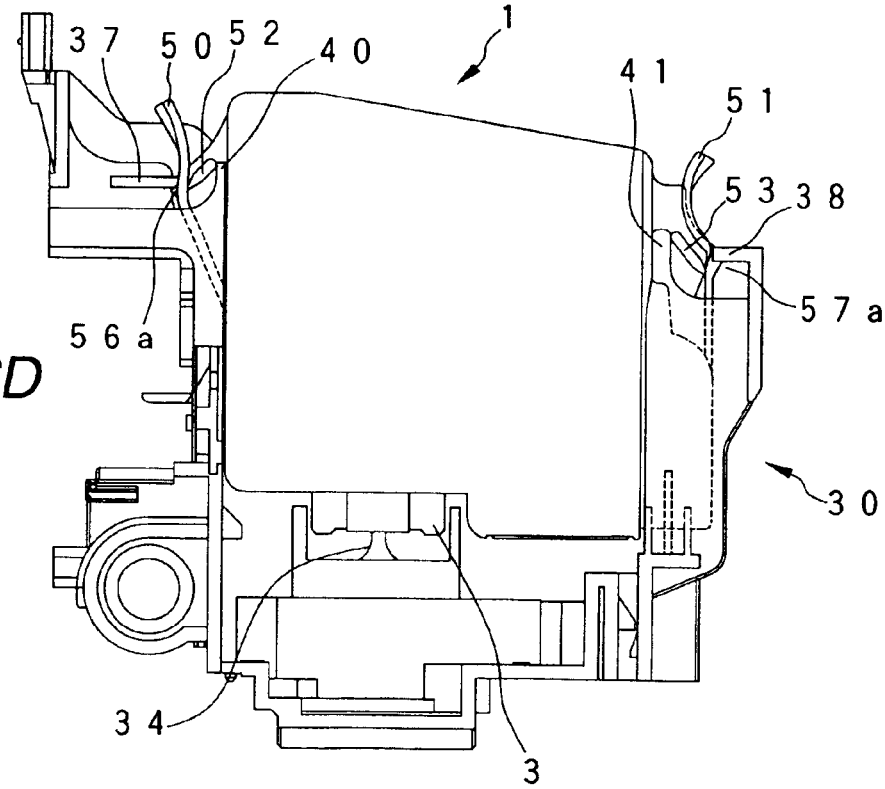
FIG. 6D is a diagram showing the ink cartridge mounted onto the ink cartridge holder.

When the ink cartridge 1 is inserted into the ink cartridge holder 30, during the insertion process shown in FIG. 6D, unlocking projections 40 and 41, formed on the ink cartridge holder 30, push the struts 52 and 53 of the ink cartridge 1 upward. Consequently, the distal ends of the struts 52 and 53 are moved over the semi-circular projections 54 and 55 and the struts 52 and 53 are shifted upward so that they no longer limit movement of the pawls 56 and 57.

When the ink cartridge 1 is further depressed in this state, since the levers 50 and 51 are no longer supported by the struts 52 and 53, the pawls 56 and 57 are guided inward of the engagement portions 37 and 38 due to contact with the slopes 56*a* and 57*a*, and snap outward under the lower faces of the engagement portions 37 and 38. At this time, a perceptible click, resulting from the elastic energy of the released levers 50 and 51 as they sprint out into position, is provided to a user, who can sense when the ink cartridge 1 has reached its intended position. Accordingly, the user can avoid unnecessarily depressing the ink cartridge 1.

Figure 7A:
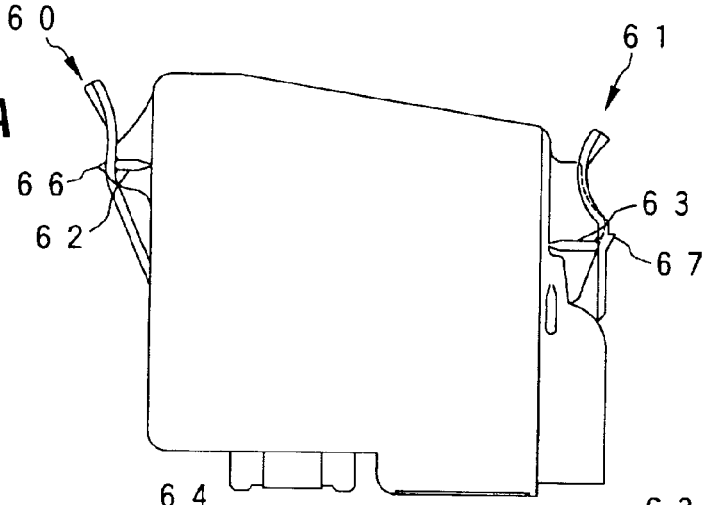
FIG. 7A is a diagram showing an ink cartridge according to yet another embodiment which has been removed from an air-impermeable bag.
Figure 7B:
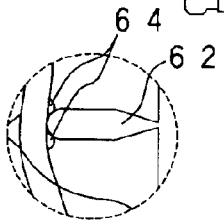
FIGS. 7B and 7C are enlarged diagrams showing the area in the vicinity of struts of the ink cartridge.
Figure 7C:
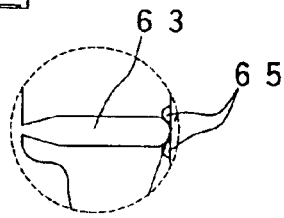

FIGS. 7A to 7C are diagrams showing an ink cartridge according to yet another embodiment of the invention, in which struts 62 and 63, located behind pawls 66 and 67 of levers 60 and 61, are formed integrally with the container 2.

As depicted, pivotable struts 62 and 63 are formed on the side faces 4 and 5 of the container 2 to be substantially opposed to the pawls 66 and 67 of the levers 60 and 61. Furthermore, semi-circular projections 64 and 65 are formed on the rear faces of the levers 60 and 61, opposed to the side faces 4 and 5 of the container 2, behind the pawls 66 and 67.

According to this embodiment, when the ink cartridge 1 is shipped from a factory, the ink cartridge 1 is stored in an air-impermeable film bag under reduced pressure (less than ambient pressure), with the free ends of the struts 62 and 63 engaging the semi-circular projections 64 and 65 of the levers 60 and 61. Since the struts 62 and 63 are held substantially perpendicular to the side faces 4 and 5 by the semi-circular projections 64 and 5, the pawls 66 and 67 of the levers 60 and 61 cannot be forced inward toward the container 2 beyond the length of the struts 62 and 63.

Figure 7D:
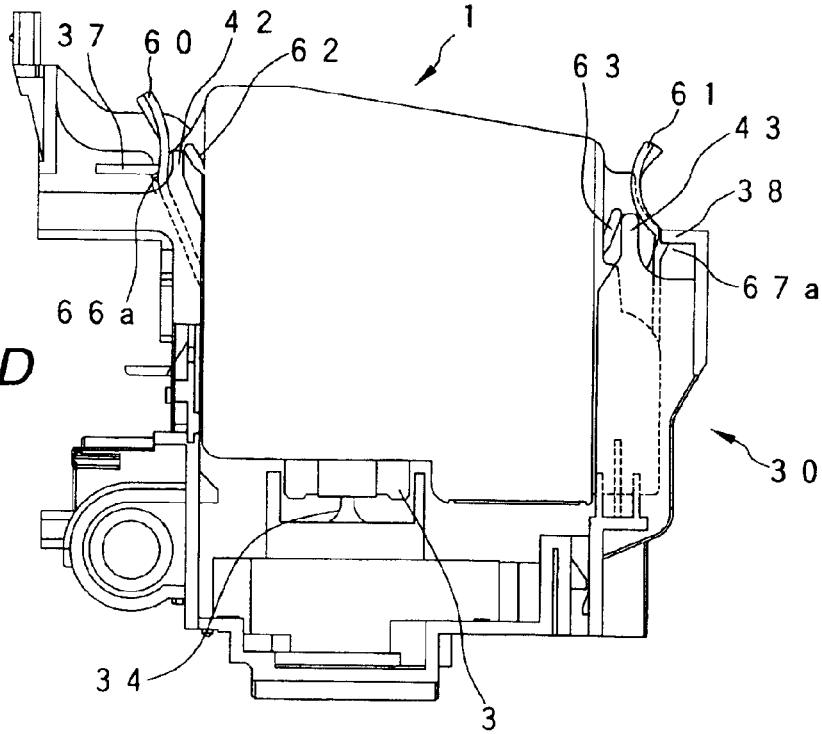
FIG. 7D is a diagram showing the ink cartridge mounted onto the ink cartridge holder.

When the ink cartridge 1 is inserted into the ink cartridge holder 30, during the insertion process shown in FIG. 7D, unlocking projections 42 and 43, formed on the ink cartridge holder 30, push the struts 62 and 63 of the ink cartridge 1 upward. As a result, the distal ends of the struts 62 and 63 are pushed over the semi-circular projections 64 and 65, and the struts 62 and 63 are displaced upward.

When the ink cartridge 1 is further depressed in this state, since the levers 60 and 61 are no longer supported by the struts 62 and 63, the pawls 66 and 67 are urged inward of the engagement portions 37 and 38 by the contact of the slopes 66*a* and 67*a* with the engagement portions 37 and 38, and then snap outward under the lower faces of the engagement portions 37 and 38. At this time, a perceptible click, resulting from the elastic energy of the released levers 60 and 61 as they sprint out into position is given to the user, who can sense when the ink cartridge has reached its intended position. Accordingly, the user can avoid unnecessarily depressing the ink cartridge 1.

Figure 8A:
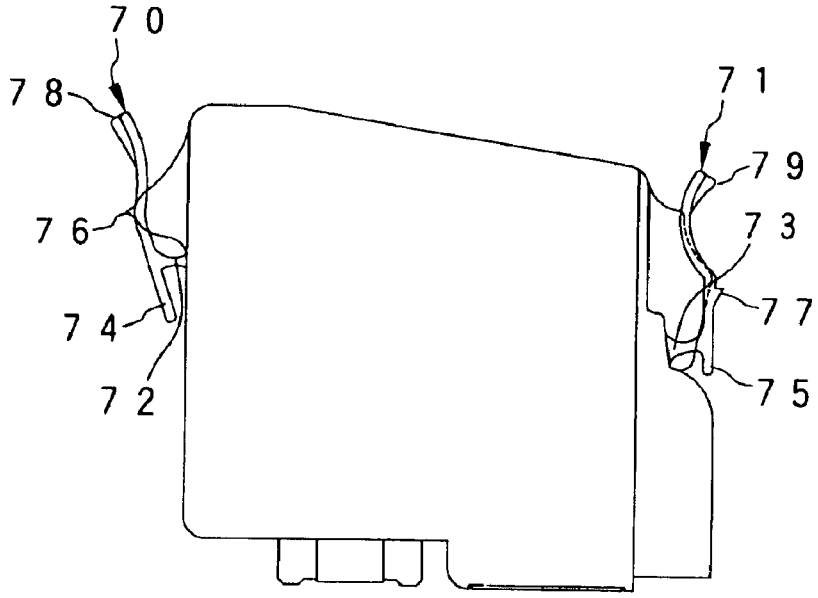
FIG. 8A is a diagram showing an ink cartridge according to still another embodiment which has been removed from an air-impermeable bag.

FIG. 8A is a diagram showing an ink cartridge according to a further embodiment of the invention. Levers 70 and 71 are formed on the side faces 4 and 5 of the container 2, and are rotatably supported at their central portions by flexible struts 72 and 73. The lower ends of the levers 70 and 71 are free. Portions of the levers 70 and 71 below the struts 72 and 73 serve as short ribs 74 and 75.

According to this embodiment, in the case where the ink cartridge 1 is stored in an air-impermeable film bag under reduce pressure (pressure less than ambient pressure), the grips 78 and 79 of the levers 70 and 71 are pressed inward toward the container 2 and may be deformed substantially. Nevertheless, since the ribs 74 and 75 are short and rigid, almost no creeping occurs in those ribs 74 and 75.

Figure 8B:
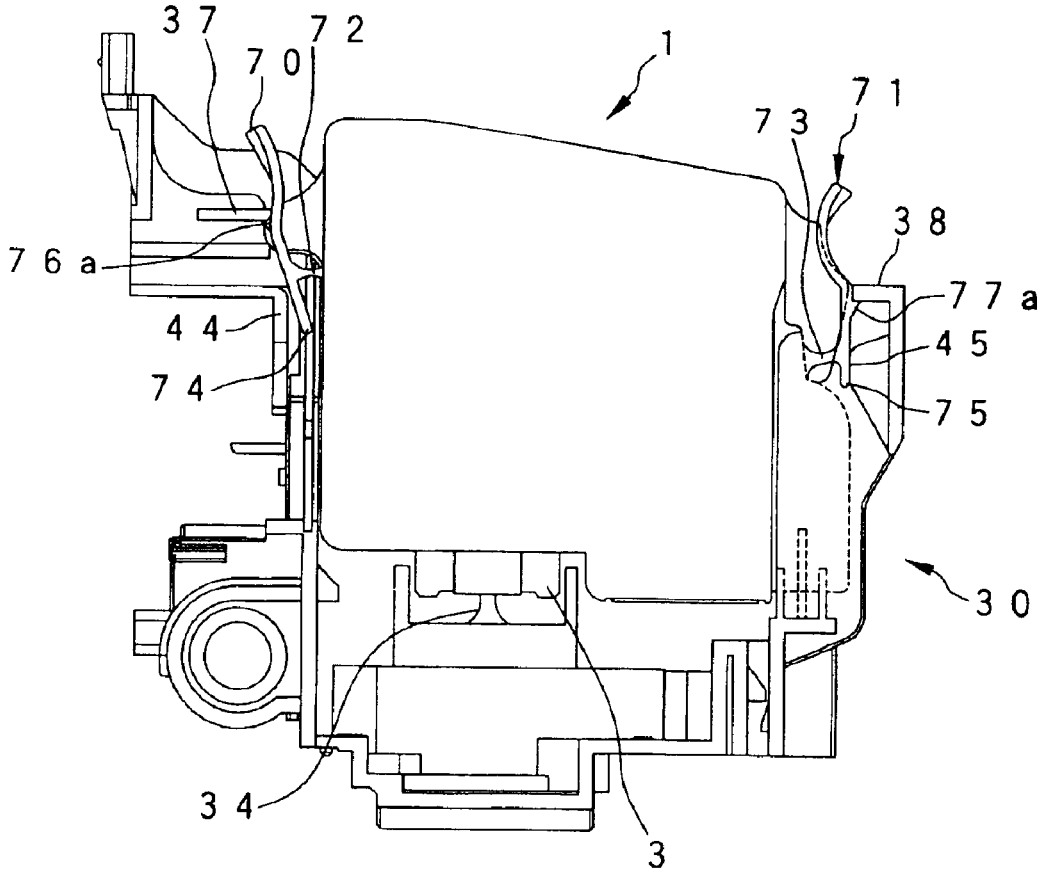
FIG. 8B is a diagram showing the ink cartridge mounted onto the ink cartridge holder.

When the ink cartridge 1 is depressed into the ink cartridge holder 30, as is shown in FIG. 8B, the ribs 74 and 75 of the levers 70 and 71 first contact with and are guided by side walls 44 and 45 of the ink cartridge holder 30 so that the levers 70 and 71 rotate about the roots of the struts 72 and 73 until they stand substantially upright.

Therefore, even if the grips 78 and 79 are deformed by creeping, the pawls 76 and 77 are located outside the engagement portions 37 and 38 of the ink cartridge holder 30.

Accordingly, even if the grips 78 and 79 of the levers 70 and 71 creep-deformed toward the container 2 due to the storage of the ink cartridge 1 in an air-impermeable film bag under reduced pressure, the pawls 76 and 77 can be securely brought in contact with the lower portions of the engagement portions 37 and 38. As a result, a perceptible click, resulting from this elastic energy, is provided to a user, who can sense that the ink cartridge 1 has reached its specified position. Accordingly, the user can avoid unnecessarily depressing ink cartridge 1.

Figure 9A:
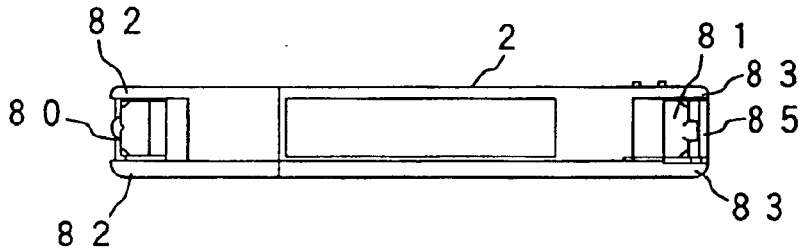
FIGS. 9A to 9C are top, side and front and views, respectively, of an ink cartridge according to a further embodiment of the invention.
Figure 9C:
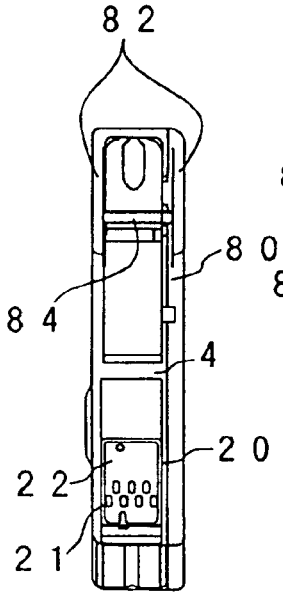
Figure 9B:
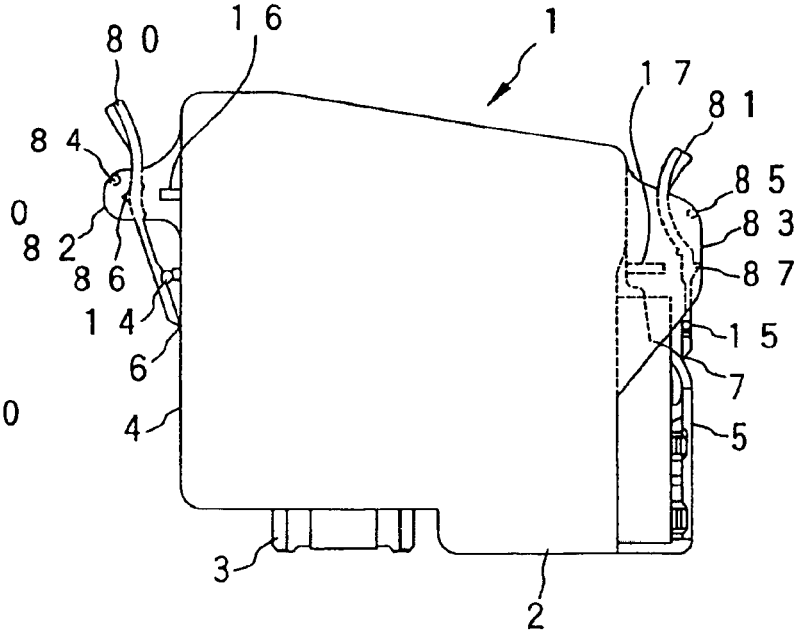

FIGS. 9A to 9C are diagrams showing an ink cartridge 1 according to a still further embodiment of the invention. In this embodiment, tab portions 82 and 83 are formed to project from the obverse surface and/or the reverse surface of a container 2, extending to the region of pawls 86 and 87 of levers 80 and 81. Further, crosswise struts 84 and 85 are formed on the tab portions 82 and 83 opposite the movable levers 80 and 81, so that they are positioned outside (further from body 2) the levers 80 and 81.

According to the embodiment, where the ink cartridge 1 is stored in an air-impermeable film bag under reduced pressure (pressure less than ambient pressure), the levers 80 and 81 are protected by the struts 16 and 17 as previously described, and so they are prevented from being creep-deformed toward the container 2. Also, unnecessary outward displacement of the levers 80 and 81 can be prevented by the struts 84 and 85 of the tab portions 82 and 83.

Specifically, since the tab portions 82 and 83 and the struts 84 and 85 function as protective members for the levers 80 and 81, the pawls 86 and 87 are prevented from being deformed by colliding with others, so that the pawls 86 and 87 can securely be engaged with the ink cartridge holder 30.

Figure 10:
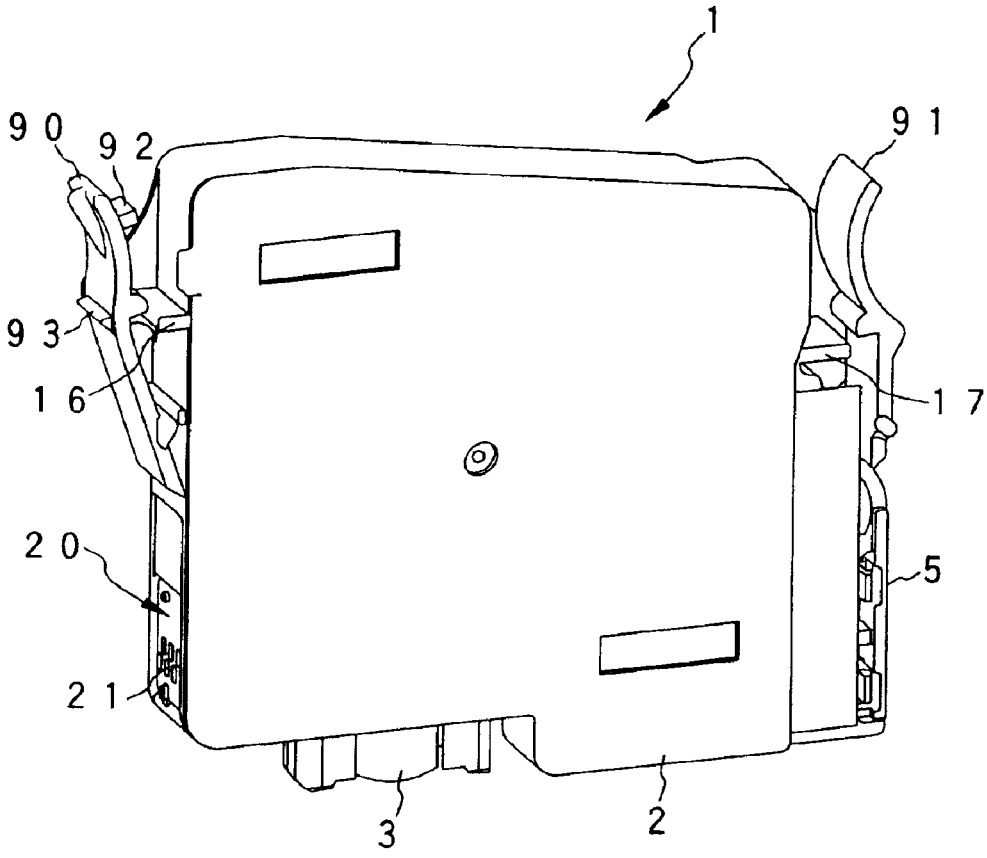
FIG. 10 is a perspective view showing an ink cartridge according to a still further embodiment of the invention.

FIG. 10 is a diagram showing an ink cartridge 1 according to a further embodiment of the invention. A strut 92 is formed on at least one of the levers 90 and 91 (i.e. at least on the lever 90 provided on a face of the container 2 where the storage device 20 is disposed). The strut 92 is disposed substantially on an upper end portion, i.e. a movable free end portion, of an inner face of the lever 90, which face of the lever is opposed to the container 2.

According to the embodiment, even if the ink cartridge 1 is stored in an air-impermeable film bag under reduced pressure (less than ambient pressure), the creep-deformation of the lever 90 is prevented by supporting the upper end of the lever 90 with the strut 92. Thus, when the ink cartridge 1 is mounted onto the ink cartridge holder 30, at the least the lever 90 is not creep-deformed, and the lever 90 can be elastically deformed outward by the protruded stopper portion 16 to securely engage a pawl 93 with the engagement portion 37 of the ink cartridge holder 30.

As a result, the electrodes 21 of the storage device 20 can be securely contacted to the contact points of the ink cartridge holder 30, and proper electrical contact therebetween can be maintained.

As described above, according to the invention, when an ink cartridge is mounted to an ink cartridge holder, levers on both side faces of the ink cartridge are forcibly urged outward by the structure of the ink cartridge holder. Thus, not only can a user be notified of the exact time the pawls of the levers have been engaged with the ink cartridge holder, but also it is possible to maintain the state in which the pawls are engaged with the ink cartridge holder with a predetermined strength regardless of the elasticity and/or deformation of the levers.

What is claimed is:

1. An ink cartridge having a container that accommodates an ink therein, and an ink supply port that communicates with an interior of the container and through which the ink is supplied to a recording head when the ink cartridge is mounted on an ink cartridge holder of a recording apparatus, the ink cartridge comprising:

a lever pivotally attached to a wall of the container so as to move toward and away from the wall of the container;

a pawl on the lever, which said pawl engages with the ink cartridge holder; and a protruded guide portion that contacts the ink cartridge holder to guide the lever along an opening direction.

2. The ink cartridge according to claim 1, further comprising:

a protruded stopper portion which allows the lever to pivot to a position from which the pawl can be disengaged from the ink cartridge holder.

3. The ink cartridge according to either of claims 1 or 2, wherein the protruded guide portion is formed on a side face of the lever.

4. The ink cartridge according to either of claims 1 or 2, wherein a lower end side of the protruded guide portion is tapered.

5. An ink cartridge according to claim 1, wherein the protruded guide portion is an integral projection extending outward from the lever.

6. An ink-jet recording apparatus that receives ink from an ink cartridge having a container containing, the ink therein, an ink supply port that communicates with an interior of the container, a lever pivotally attached to a wall of the container so as to pivot forward and away from the wall of the container, a pawl on the lever, and a protruded guide portion for moving the lever in an opening direction, the apparatus comprising:

an ink cartridge holder which receives the ink cartridge;

a vertically extending guide portion, formed on the ink cartridge holder, that engages the protruded guide portion to guide the lever along the opening direction.

7. The ink-jet recording apparatus according to claim 6, wherein the guide portion has the shape of a groove or a window, and has a sloped upper end.

8. An ink cartridge for use in an ink cartridge holder of a recording apparatus, the ink cartridge having a container containing ink therein, and an ink supply port communicating with an interior of the container and through which ink is supplied to a recording head when the ink cartridge is mounted, the ink cartridge comprising:

a lever pivotally attached to a wall of the container so as to pivot forward and away from the wall of the container;

a pawl on the lever, which said pawl engages with the ink cartridge holder; and a movable strut supporting the pawl of the lever.

9. The ink cartridge according to claim 8, further comprising a plurality of small projections dimensioned and disposed to contact and limit movement of a free end of said movable strut.

10. The ink cartridge according to claim 8, wherein the movable strut is formed on the wall of the container.

11. The ink cartridge according to claim 10, further comprising a plurality of small projections formed on said lever and dimensioned and disposed to contact and limit movement of a free end of said movable strut.

12. An ink-jet recording apparatus that receives ink from an ink cartridge having a container containing the ink therein, an ink supply port communicating with an interior of the container, a lever pivotally attached to a wall of the container so as to pivot torward and away from the wall of the container, a pawl on the lever, and a movable strut supporting the pawl of the lever, the apparatus comprising:

an ink cartridge holder that accommodates the ink cartridge; and a projection, formed in the ink cartridge holder, that contacts the strut to cause the strut to pivot and be displaced.

13. An ink cartridge for use in an ink cartridge holder of a recoding apparatus, the ink cartridge having a container containing ink therein, and an ink supply port communicating with an interior of the container and through which ink is supplied to a recording head when the ink cartridge is mounted, the ink cartridge comprising:

a lever formed on a wall of the container, the lever having a compliant strut located at an approximate center of the lever, the lever pivoting about said at a position between the ends of the lever; and a pawl on the lever, which said pawl engages with the ink cartridge holder.

14. The ink cartridge according to any one of claims 1, 2, 8, 10 and 13, further comprising:

a tab portion, formed on the container, for covering a side face of the lever; and a protective strut, for preventing the lever from opening outwardly.

15. The ink cartridge according to any one of claims 1, 2, 8, 10, and 13, further comprising:

a supporting strut located on a movable free end portion of a face of the lever, the face of lever opposing the container.

16. The ink cartridge according to any one of claims 1, 2, 8, 10, and 13, wherein the ink cartridge has two said levers, said levers being respectively provided on each of two opposite walls of the container.

17. An ink-jet recording apparatus that receives ink from an ink cartridge having a container containing the ink therein, a lever formed on a wall of the container and provided at an approximate center of the lever, the lever having a compliant strut, the lever pivoting about the compliant strut, and a pawl on the lever, the apparatus comprising:

an ink cartridge holder that accommodates the ink cartridge;

a face, formed in the ink cartridge holder, that contacts a lower region of the lever below the strut.

18. An ink cartridge having a container that accommodates an ink therein, and an ink supply port that communicates with an interior of the container and through which the ink is supplied to a recording head when the ink cartridge is mounted on an ink cartridge holder of a recording apparatus, the ink cartridge comprising:

a lever pivotally attached to a wall of the container so as to move toward and away from the wall of the container;

a pawl on the lever, which said pawl engages with the ink cartridge holder, and a protruded guide portion disposed on the lever and which contacts the ink cartridge holder to guide the lever along an opening direction.

19. An ink cartridge having a container that accommodates an ink therein, and an ink supply port that communicates with an interior of the container and through which the ink is supplied to a recording head when the ink cartridge is mounted on an ink cartridge holder of a recording apparatus, the ink cartridge comprising:

a lever having one end attached to a wall of the container and another end which is a free end;

an engagement portion on the lever, which said engagement portion engages with the ink cartridge holder; and a guide portion that contacts the ink cartridge holder and guides the lever to a predetermined position as the ink cartridge is mounted.

20. The ink cartridge according to claim 19, further comprising:

a protruded stopper portion which allows the lever to pivot to a position at which the pawl can be disengaged from the ink cartridge holder.

21. The ink cartridge according to either of claims 19 or 20, wherein the protruded guide portion is formed on a side face of the lever.

22. The ink cartridge according to either of claims 19 or 20, wherein a lower end side of the protruded guide portion is tapered.

23. An ink cartridge according to claim 19, wherein the guide portion is an integral projection extending outward from the lever.

24. An ink cartridge according to claim 19, wherein the engagement portion engages with the ink cartridge holder when the lever is guided to the predetermined position.

25. An ink cartridge for use in an ink cartridge holder of a recording apparatus, the ink cartridge having a container containing ink therein, and an ink supply port communicating with an interior of the container and through which ink is supplied to a recording head when the ink cartridge is mounted, the ink cartridge comprising:

a lever having one end attached to a wall of the container and another end which is a free end;

an engagement portion on the lever, which said engagement portion engages with the ink cartridge holder; and a movable strut supporting the engagement portion of the lever.

26. An ink cartridge for use in an ink cartridge holder of a recoding apparatus, the ink cartridge having a container containing ink therein, and an ink supply port communicating with an interior of the container and through which ink is supplied to a recording head when the ink cartridge is mounted, the ink cartridge comprising:

a lever having one end attached to a wall of the container and another end which is a free end, the lever having a compliant strut located at an approximate center of the lever, the lever pivoting about said strut at a position between the ends of the lever; and an engagement portion on the lever, which said engagement portion engages with the ink cartridge holder.

27. An ink cartridge having a container that accommodates an ink therein, and an ink supply port that communicates with an interior of the container and through which the ink is supplied to a recording head when the ink cartridge is mounted on an ink cartridge holder of a recording apparatus, the ink cartridge comprising:

a lever having one end attached to a wall of the container and another end which is a free end;

an engagement portion on the lever, which said engagement portion engages with the ink cartridge holder; and a guide portion disposed on the lever and which contacts the ink cartridge holder and guides the lever to a predetermined position as the ink cartridge is mounted.

* * * * *